US005362893A

United States Patent [19]

Muylle et al.

[11] Patent Number: 5,362,893

[45] Date of Patent: Nov. 8, 1994

[54] METHOD FOR REFINING GLYCERIDE OIL

[75] Inventors: Joose R. L. Muylle; Albert J. Dijkstra, both of Kortrijk; Pieter J. A. Maes, Harelbeke; Martin Van Opstal, Izegem, all of

[73] Assignee: N.V. Vandemoortele International, Kortrijk,

[21] Appl. No.: 26,418

[22] Filed: Mar. 4, 1993

[30] Foreign Application Priority Data

Mar. 9, 1992 [EP] European Pat. Off. ..... 92200665.5

[51] Int. Cl.[5] ..... C11B 3/06

[52] U.S. Cl. ..... 554/195; 554/198; 554/200; 554/204

[58] Field of Search ..... 554/195, 198, 200, 204

[56] References Cited

U.S. PATENT DOCUMENTS 4,049,686 9/1977 Ringers et al. ..... 554/204

FOREIGN PATENT DOCUMENTS 349718 1/1990 European Pat. Off. .

2360146 6/1975 Germany .

*Primary Examiner*—Joseé G. Dees

*Assistant Examiner*—Dwayne C. Jones

*Attorney, Agent, or Firm*—Cushman, Darby & Cushman

[57] ABSTRACT

The present invention relates to a process for refining glyceride oil comprising a neutralization treatment in which alkali is mixed into crude or water degummed glyceride oil and a separation treatment in which the soapstock formed is separated from the glyceride oil by subjecting the oil to two centrifugal separators in series, in which at least 1 wt. % of the oil passes through both separators twice.

6 Claims, No Drawings

METHOD FOR REFINING GLYCERIDE OIL

BACKGROUND OF THE INVENTION

The present invention relates to a method of refining glyceride oil, and in particular to such a method comprising a neutralization treatment in which alkali is mixed into crude or water degummed glyceride oil and a separation treatment in which the soapstock so formed is separated from the glyceride oil.

Glyceride oils of in particular vegetable origin, such as soybean oil, rapeseed oil, sunflower oil, safflower oil, cotton seed oil and the like, are valuable raw material for the food industries. These oils in crude form, usually obtained from seeds and beans by pressing and/or solvent extraction, contain several compounds other than triglycerides. Some of these compounds such as phosphatides, free fatty acids, odours, colouring matter, waxes and metal compounds must be removed because they adversely affect taste, smell, appearance and keepability of the refined oil.

In general, the first step in the refining of glyceride oils is the so-called degumming step, i.e. the removal of phosphatides. In conventional degumming processes water is added to the crude glyceride oil at a temperature ranging from 60° to 90° C. to hydrate the phosphatides, which are subsequently removed, e.g. by centrifugal separation.

However, most of the afore mentioned impurities, including the non-hydratable phosphatides, require a chemical treatment to remove them and refining by neutralization with alkali is generally operated to this end. Alkali refining comprises, in its broadest sense, addition of an aqueous alkali solution to crude or water-degummed oil, hydration and a separation treatment in which the soapstock thus formed is removed from the glyceride oil. The alkali-refined glyceride oil is finally washed once or twice with water to remove residual soaps that otherwise affect subsequent refining by bleaching.

Entrainment of triglyceride oil with the soapstock and with the washing water, and saponification of triglyceride oil through contact with the refining agent constitute important refining losses.

Therefore, a multitude of modifications to the original alkali refining technique have been developed in an attempt to reduce these refining losses.

The most frequently applied modification constitutes the removal of the phosphatides prior to the alkali refining to reduce emulsification of triglyceride oil in the soapstock. Another modification entails pretreatment with acid of the glyceride oil to be alkali refined. It has been found that this pretreatment assists in the removal of phosphatides and pro-oxidant metal ions, such as iron and copper. U.S. Pat. No. 2,666,074 describes the use of aqueous solutions of polybasic aliphatic acids such as citric acid and tartaric acid and U.S. Pat. No. 2,702,813 describes the use of 75 to 85% phosphoric acid at levels of 0.05 to 0.15% in the oil. Such pretreatments are found to reduce emulsification of triglyceride oil and soapstock and saponification of triglyceride oil through the buffing action of the acid.

The separation stage in the alkali refining process is the most critical one since it determines the overall yield to an even greater extent than proper pretreatment.

In continuous refining, high-speed centrifuges are used to separate the oil/reagent mixture into neutral oil and soapstock. Even under optimum conditions there can never be complete separation between neutral, soap-free oil on the one hand and soaps, phosphatides, free reagent and water on the other. In all cases, a compromise has to be made between separating the soapstock with the least amount of entrained oil and thus allowing an amount of soaps to pass along with the glyceride oil for removal in subsequent washing stages, and allowing a proportion of glyceride oil to be entrained with the soapstock to yield a neutral oil with minimum residual soap content. In case an oil with minimum residual soap content is aimed at, there is also a risk that soaps become so diluted with triglyceride oil that the resistance of the soapstock outlet drops and the soapstock and the oil phase are removed from the centrifuge at the soapstock outlet under the counter pressure at the oil phase outlet.

Washing entails mixing an amount of water into the oil phase followed by removal of this washing water from the neutral oil. Alkali solutions can be used instead of water to neutralize remaining free fatty acids or diluted acid can be use to convert the residual soaps into free fatty acids to avoid emulsification and to achieve proper separation.

These washing stages however, have the disadvantage that they may again lead to triglyceride oil losses and may cause additional pollution and/or effluent disposal problems.

OBJECTS OF THE INVENTION

Therefore it is the object of the invention to provide a glyceride oil refining process comprising a neutralization treatment in which alkali is mixed into crude or water degummed glyceride oil and a separation treatment in which the soapstock so formed is separated from the glyceride oil, which process does not entail high triglyceride oil losses and which does provide triglyceride oil that can be bleached by any conventional bleaching process and applying conventional amounts of bleaching earth, without prior washing stages being required.

It is an additional object of the present invention to minimize aqueous effluent without affecting refining yield and oil quality.

These and further objects and advantages will become apparent as the description of the invention proceeds.

DETAILED DESCRIPTION OF THE INVENTION

The present invention relates to a glyceride oil refining process comprising a neutralization treatment in which alkali is mixed into the glyceride oil and a separation treatment in which the soapstock formed is separated from the glyceride oil by subjecting the oil to two centrifugal separators in series, in which at least 1 wt. % of the oil passes through both separators twice.

The performance of a centrifugal separator can commonly be adjusted to yield either a soapstock with low triglyceride oil content or a triglyceride oil stream with low soap content but in practice and at normal design throughput a centrifugal separator cannot achieve both. Thus, if a centrifugal separator is adjusted to yield a soapstock with a minimum triglyceride oil content (preferably less than 30 wt. %), the triglyceride oil leaving the equipment is found to contain a significant fraction of the soaps originally present in the feed that is not removed from the oil under those operating conditions.

The second centrifugal separator in the process according to the invention is adjusted to yield oil with minimum residual soap content, as a result of which the soapstock removed at this second centrifugal separation has a high triglyceride oil content. Therefore, this latter soapstock is recycled into the oil fed to the first centrifugal separator.

It has now surprisingly been found that soaps can be removed from the oil effectively by only two centrifuges in series, whereby at least 1 wt. % of the oil passes through both separators twice, to a level that in normal industrial practice is only attainable by introduction of two or more washing stages. The present invention thus provides an alkali refining process which involves lower investment and lower operational costs.

The present process has advantages over prior art processes in that it yields a neutral oil with minimal residual soap content without washing stages being required, while triglyceride oil losses are reduced to a strict minimum and in that vast effluent disposal problems are eliminated. In addition, the risk for occasional and sudden large oil losses due to the diversion by the centrifuge of its oil stream to the soapstock stream is also largely reduced.

It has also been found, that mixing an amount of water into the oil resulting from the first centrifugal separator prior to being fed to the second centrifugal separator causes the oil resulting from the second centrifugal separator to have an even lower residual soap, iron and phosphorus content. It has also been found that, by recycling the wet triglyceride oil rich soapstock resulting from the second centrifugal separator into the oil stream fed to the first centrifugal separator, no flushing of the first centrifugal separator is required anymore.

The water to be mixed into the oil obtained from the first centrifugal separator may be water, diluted nontoxic acid, e.g. citric acid, water containing salts or diluted nontoxic alkali. The amount of water generally ranges from 0.01 to 10 wt. %, preferably between 0.5 and 5 wt %.

The process according to the present invention can advantageously be used in any conventional alkali refining process, provided the treatment with refining agents has been operated under optimum conditions. This treatment may include e.g. a pretreatment to remove hydratable phosphatides and/or pretreatment of the oil with acid prior to the alkali treatment as outlined above.

The oil to be refined by the process according to the invention is not critical. Edible triglyceride oils like soybean oil, sunflowerseed oil, rapeseed oil, palm oil and other vegetable oils as well as lard, tallow and especially fish oil can all be successfully refined.

The amount of oil to be recycled into the oil fed to the first centrifugal separator depends upon the operating conditions of both centrifugal separators, in particular upon the operating conditions of the second one. Since a refined oil with minimal soap content is intended, the soapstock resulting from the second centrifugal separator, which is fully recycled into the oil fed to the first centrifugal separator, will have a relatively high triglyceride oil content. In practice, the amount of oil to be recycled into the oil fed to the first centrifuge is at least 1 wt. %, calculated upon the oil fed to the first centrifugal separator, to be advantageous.

The process according to the invention can use disc centrifuges, decanters or other equipment capable of continuously separating a soapstock from an oil phase. Decanters to be used preferably contain a circular disc acting as a seal prior to the conical section. Disc centrifuges used in the process according to the invention can employ a continuous and/or intermittent soapstock removal system and the continuous removal can be of the type employing a centrifugal pump or nozzles in the outer ring of the centrifugal bowl. The soapstock removal system commonly used consists of a centripetal pump or nozzles for continuous soapstock removal or of a temporary opening of the centrifugal bowl allowing accumulated solids to be discharged. Preferably, the centrifugal equipment used in the process according to the invention rotates at high speed. Such high speeds increase the centrifugal force and thus facilitate the separation.

The present invention is illustrated by the following examples wherein phosphorus and iron content of the oil are determined by plasma emission spectroscopy (A. J. Dijkstra and D. Meert, J.A.O.C.S. 59 (1982), 199), soap content of the oil is determined by A.O.C.S. method Cc 17-79, free fatty acid content of the oil is determined by A.O.C.S. method Ca 5a-40 and fatty acid and triglyceride oil content of the soapstock are determined by the procedure described below.

Take an amount of fresh soapstock and mix it with a citric acid solution (50%) to obtain a pH<3. After decantation of the excess of water, the acidulated soapstock is extracted first with a 20-fold quantity of petroleum ether (boiling point 40°-60° C.), followed by a second extraction with a 20-fold quantity of chloroform.

The combined extracts are evaporated on a Rotavapor to complete dryness. Weigh out accurately about 1 g of the dried soapstock extract, add about 600 mg dodecanoic acid and 200 mg triheptadecanoine (internal standards for fatty acid determination respectively for determination of the triglyceride oil content) and dissolve in approximately 10 ml of chloroform and methanol (2:1).

A sample of 1 ml of this solution is applied in one single streak on a TLC-plate (Silicagel plates Merck nr 5717) and developed in a system of diethylether—petroleumether—acetic acid (50:49:1). After visualisation, the typical streaks of triglycerides and fatty acids are scraped off separately and extracted twice with approximately 50 ml of diethylether, dried with sodium sulphate and evaporated on a Rotavapor.

Methylester preparation is carried out according to the procedures described in FSA 1971, 216. Gaschromatographic analysis is carried out according to common practice. Fatty acid and triglyceride oil content is calculated with reference to the internal standards.

COMPARATIVE EXAMPLE 1

In this comparative example the continuous removal of soapstock from triglyceride oil, in accordance with common practice, is illustrated.

The feed consisted of partially water-degummed rapeseed oil having a temperature of approximately 105° C., a residual phosphorus content of approximately 271 ppm, an iron content of approximately 4.3 ppm and a free fatty acid content of approximately 1.05 %. This partially water-degummed oil, at a throughput of 9 tons per hour was mixed with 0.15 vol. % phosphoric acid of 80 % strength, allowed to contact for approximately 2.5 min. and neutralized with approximately 1.25 vol. % 26° Bë sodium hydroxide.

The neutralized oil was fed to a solid bowl centrifuge provided with the standard top disc and separated into a soapstock and an oil phase. The resulting oil was then washed twice with common wash centrifuges and approximately 10% water.

The quality of the oil at different stages of the process is summarized in Table 1.

The soapstock resulting from the first centrifuge contained approximately 61.9 wt. % of soaps and 21.1 wt. % of triglyceride oil (calculated on fatty matter) and was discharged. The washing water resulting from the first washing stage contained approximately 0.37 wt. % soaps and 0.08 wt. % triglyceride oil, whereas the washing water resulting from the second washing stage contained approximately 0.004 wt. % soaps and 0.004 wt. % triglyceride oil.

TABLE 1

| | P (ppm) | Fe (ppm) | ffa (%) | soaps (ppm) |
|---|---|---|---|---|
| partially water-degummed oil | 271 | 4.3 | 1.05 | 1 |
| after first centrifuge | n.a. | n.a. | n.a. | 600 |
| after first washing stage | n.a. | n.a. | n.a. | 88 |
| after second washing stage | 1.0 | 0.02 | 0.026 | 61 |

Triglyceride oil loss of the process line can be calculated as being the sum of the amount of triglyceride oil entrained with the soapstock and the amount of triglyceride oil removed during the washing stages. The latter is estimated at 0.01%.

(Sffa * trigl. oil content soapstock)/soap content soapstock+0.01%, or [(1.024 * 21.1)/61.9+0.01]=0.359%

EXAMPLE 1

In this example the continuous removal of soapstock from triglyceride oil according to the invention is illustrated.

The feed consisted of partially water-degummed rapeseed oil having a temperature of approximately 105° C., a residual phosphorus content of approximately 265 ppm, an iron content of approximately 5.8 ppm and a free fatty acid content of approximately 1.09%. This partially water-degummed oil, at a throughput of 9 tons per hour was mixed with 0.15 vol. % phosphoric acid of 80 % strength, allowed to contact for approximately 2.5 min. and neutralized with approximately 1.25 vol. % 26° Bë sodium hydroxide as in the comparative example 1.

The neutralized oil was fed to a first centrifuge and continuously separated into a soapstock and an oil phase which still contained a fraction of the soaps originally present in the feed. The oil phase was subjected to a second centrifuge yielding a neutral oil and a second soapstock which was fully recycled into the oil fed to the first centrifuge. Soon after startup a steady state was observed.

The first centrifuge used in this experiment was a solid bowl disc centrifuge provided with the standard top disc as in the comparative example 1 and the second centrifuge was a self cleaning disc centrifuge in which the bowl had been provided with nozzles for continuous gum discharge.

The quality of the oil at different stages of the process is summarized in Table 2.

The soapstock resulting from the first centrifuge contained approximately 70.4 wt. % of soaps and 17.6 wt. % of triglyceride oil (calculated on dry matter) and was discharged. The soapstock resulting from the second centrifuge contained approximately 98 wt. % of triglyceride oil and 0.16 wt. % soaps (calculated on dry matter) and was fully recirculated into the oil fed to the first centrifuge. The amount of recirculated stream was approximately 2820 Kg per hour.

TABLE 2

| | P (ppm) | Fe (ppm) | ffa (%) | soaps (ppm) |
|---|---|---|---|---|
| partially water-degummed oil | 265 | 5.8 | 1.09 | 2 |
| after first centrifuge | n.a. | n.a. | n.a. | 551 |
| after second centrifuge | 3.3 | 0.026 | 0.023 | 77 |

Triglyceride oil loss of the process according to the invention can be calculated in the same way as in the preceding comparative example.

(Sffa * trigl. oil content soapstock)/soap content soapstock, or (1.067 * 17.6)/70.4=0.267%

From the above example it is clear that a neutral oil with minimum residual soap content can be obtained by the process according to the invention without washing stages being required, thus reducing effluent disposal problems, and with only two centrifuges instead of three. It is also made clear that less triglyceride oil is lost.

EXAMPLE 2

In this example the continuous removal of soapstock from triglyceride oil according to the invention is illustrated. The same procedure as in example 1 is repeated, except in that approximately 200 l/h. of water is mixed into the oil phase leaving the first centrifuge prior to being fed to the second centrifuge.

The feed consisted of partially water-degummed rapeseed oil having a temperature of approximately 105° C., a residual phosphorus content of approximately 288 ppm, an iron content of approximately 3.99 ppm and a free fatty acid content of approximately 0.94%.

The quality of the oil at different stages of the process is summarized in Table 3.

The soapstock resulting from the first centrifuge contained approximately 66.2 wt. % of soaps and 18.1 wt. % of triglyceride oil (calculated on dry matter) and was discharged. The soapstock resulting from the second centrifuge contained approximately 99.5 wt. % of triglyceride oil and 0.07 wt. % soaps (calculated on dry matter) and was fully recirculated into the oil fed to the first centrifuge. The amount of recirculated stream was approximately 2790 Kg per hour.

TABLE 3

| | P (ppm) | Fe (ppm) | ffa (ppm) | soaps (%) |
|---|---|---|---|---|
| partially water-degummed oil | 288 | 3.99 | 0.94 | 0 |
| after first centrifuge | n.a. | n.a. | n.a. | 236 |
| after second | 1.6 | 0.021 | 0.024 | 31 |

TABLE 3-continued

| | P (ppm) | Fe (ppm) | ffa (ppm) | soaps (%) |
|---|---|---|---|---|
| centrifuge | | | | |

Triglyceride oil loss of the process according to the invention can be calculated in the same way as in the preceding example.

(Sffa * trigl. oil content soapstock)/soap content soapstock, or (0.916 * 18.1)/66.2=0.25%

From this example it is clear that a neutral oil with an even lower phosphorus and iron content is obtained just by mixing an amount of water into the oil resulting from the first centrifuge, the triglyceride oil loss being even lower than in example 1.

We claim:

1. A process for refining glyceride oil comprising:

neutralizing glyceride oil by mixing said glyceride oil with alkali;

subjecting said neutralized glyceride oil to a first centrifugal separation during which a first soapstock, with low triglyceride oil content, is removed from an oil phase;

subjecting said oil phase from said first centrifugal separation to a second centrifugal separation to remove a second soapstock; and recycling said second soapstock into the glyceride oil subjected to said first centrifugal separator, said second centrifugal separation being adjusted to yield a glyceride oil with minimum residual soap content and said second soapstock comprising a substantial amount of glyceride oil;

such that at least 1 wt. % of said glyceride oil passes through both separators twice.

2. A process according to claim 1, further comprising mixing an amount ranging from 0.01 to 10 wt. % of water with an oil phase resulting from said first centrifugal separator.

3. A process according to claim 2, wherein said amount of water ranges from 0.5 to 5 wt. %.

4. A process according to claim 2, wherein said water is selected from the group consisting of water, diluted non-toxic acid, water containing salts and diluted non-toxic alkali.

5. A process according to claim 1, further comprising subjecting said glyceride oil to at least one of a water degumming treatment, an acid treatment or a water degumming treatment followed by an acid treatment, prior to neutralization.

6. A process for refining glyceride oil comprising a neutralization treatment in which alkali is mixed with said glyceride oil and a separator treatment whereby said separation treatment comprises subjecting said oil to two centrifugal separators in series, such that at least 1 wt. % of said oil passes through both separators twice and from 0.01 to 10 wt. % of water is mixed into an oil phase resulting from a first centrifugal separation.

* * * * *

UNITED STATES PATENT AND TRADEMARK OFFICE

CERTIFICATE OF CORRECTION

PATENT NO. : 5,362,893

DATED : November 8, 1994

INVENTOR(S) : Muylle, et al

It is certified that error appears in the above-indentified patent and that said Letters Patent is hereby corrected as shown below:

On the title page, item [75] Inventors:

Change "Joose R.L. Muylle" to --Joost R.L. Muylle--

Signed and Sealed this

Fourth Day of April, 1995

*Attest:*

Bruce Lehman

BRUCE LEHMAN

*Attesting Officer*

*Commissioner of Patents and Trademarks*

UNITED STATES PATENT AND TRADEMARK OFFICE
CERTIFICATE OF CORRECTION

PATENT NO. : 5,362,893

DATED : November 8, 1994

INVENTOR(S) : MUYLLE et al

It is certified that error appears in the above-identified patent and that said Letters Patent is hereby corrected as shown below:

On the title page, items

[75] Inventors:

After "all of" insert --Belgium--.

[73] Assignee:

After "Kortrijk," insert --Belgium--.

Signed and Sealed this

Sixth Day of June, 1995

*Attest:*

*Attesting Officer*

BRUCE LEHMAN

*Commissioner of Patents and Trademarks*